United States Patent [19]

Gombos et al.

[11] Patent Number: 4,765,802

[45] Date of Patent: Aug. 23, 1988

[54] ELECTROSTATIC PRECIPITATOR PLATE SPACER AND METHOD OF INSTALLING SAME

[75] Inventors: Thomas M. Gombos, Munhall; Kristen Risa, Pittsburgh, both of Pa.

[73] Assignee: Wheelabrator Air Pollution Control Inc., Pittsburgh, Pa.

[21] Appl. No.: 73,724

[22] Filed: Jul. 15, 1987

[51] Int. Cl.[4] ..... B03C 3/08

[52] U.S. Cl. ..... 55/2; 55/130; 55/145; 55/156

[58] Field of Search ..... 55/2, 143, 145, 156, 55/130, 154

[56] References Cited

U.S. PATENT DOCUMENTS

| | | | |
|---|---|---|---|
| 1,600,496 | 9/1926 | Weiskopf . | |
| 2,380,993 | 8/1945 | Yungman . | |
| 2,535,696 | 12/1950 | Richardson . | |
| 2,822,057 | 2/1958 | Richardson . | |
| 2,875,845 | 3/1959 | Penney . | |
| 3,028,715 | 4/1962 | Nodolf . | |
| 3,114,616 | 12/1963 | Palmore . | |
| 3,125,426 | 3/1964 | Herber et al. . | |
| 3,158,453 | 11/1964 | Maartman et al. . | |
| 3,372,529 | 3/1968 | Harms . | |
| 3,418,792 | 12/1968 | Quintilian et al. . | |
| 3,581,470 | 6/1971 | Aitkenhead et al. . | |
| 3,664,092 | 5/1972 | Vincent . | |
| 3,678,653 | 7/1972 | Buschman . | |
| 3,778,970 | 12/1973 | Swimmer et al. . | |
| 3,783,589 | 1/1974 | Ertl et al. . | |
| 3,803,809 | 4/1974 | Gelhaar et al. . | |
| 3,836,135 | 9/1974 | Wightman . | |
| 3,911,566 | 10/1975 | Dusevoir . | |
| 4,007,023 | 2/1977 | Bätza et al. . | |
| 4,124,359 | 11/1978 | Geller . | |
| 4,193,774 | 3/1980 | Pilat . | |
| 4,239,514 | 12/1980 | Junkers . | |
| 4,240,810 | 12/1980 | Frauenfelder . | |
| 4,332,597 | 6/1982 | Wooldridge . | |
| 4,478,614 | 10/1984 | Jonelis | 55/145 |
| 4,479,813 | 10/1984 | Jonelis . | |
| 4,516,992 | 5/1985 | Jonelis . | |
| 4,519,817 | 5/1985 | Gibbons . | |
| 4,519,818 | 5/1985 | Jonelis . | |
| 4,559,064 | 12/1985 | Ahern | 55/145 |
| 4,647,296 | 3/1987 | Tuck | 55/2 |

*Primary Examiner*—Kathleen J. Prunner

*Attorney, Agent, or Firm*—Banner, Birch, McKie & Beckett

[57] ABSTRACT

A spacer is provided for maintaining the spacing between a pair of adjacent electrostatic precipitator plates having corona electrode wires positioned midway therebetween. The plates are of the type having a generally planar vertically extending surface spaced horizontally from and extending parallel with the planar surface of an adjacent plate. Vertically extending ribs are formed on the plates, the ribs projecting perpendicular from the planar surfaces inwardly toward the ribs on the adjacent plate. The spacer includes a pair of braces which extend horizontally between the adjacent pair of precipitator plates. The braces compressively engage the vertically extending ribs therebetween. Each of the braces is provided with a pair of plate engaging edges at opposite ends thereof and at least one angled edge. The angle between the contiguous plate engaging and angled edges is greater than about 110°, in order to facilitate mounting of the spacers. The spacer has a configuration which allows it to be easily moved into a desired vertical location and locked into final position without requiring a workman to enter into the space between precipitator plates, and without the need for overcoming high frictional clamping forces during placement.

21 Claims, 5 Drawing Sheets

ELECTROSTATIC PRECIPITATOR PLATE SPACER AND METHOD OF INSTALLING SAME

BACKGROUND OF THE INVENTION

1. Field of the Invention

The present invention relates to plate type dust collecting electrostatic precipitators and in particular to a spacer for maintaining proper spacing between the electrode collector plates within the electrostatic precipitator. More particularly, the invention relates to an electrode collector plate spacer which can be installed from the sides or from the top of the electrode collector plates and mounted in the desired position within the precipitator without dismantling the plates and their supporting structure and without permanently attaching the spacer to the plates.

2. Description of the Prior Art

In the generation of electrical energy by burning coal, oil and other fuels to produce steam for power generation, a certain amount of waste material in the form of dust, dirt particles, fly ash and other particulates are produced during combustion. In the past, these waste products have simply been discharged into the atmosphere. However in recent years, more stringent environmental protection laws and regulations governing the discharge of pollutants into the atmosphere have been enacted, requiring that a larger percentage of these waste particles be collected before discharge into the atmosphere. One type of apparatus for collecting particulates from combustion product gases is the electrostatic precipitator.

Electrostatic precipitators typically have a plurality of collector electrode plates which are spaced apart from, and oriented parallel to, one another. A plurality of corona electrode wires are disposed between the spaced plates. The collector plates consist of a series of joined metal panels. The plates are suspended from a support structure and are located a fixed horizontal distance from one another. The plurality of corona electrode wires located between the spaced plates are oriented vertically. The corona electrode wires impart a charge to the dust particles as they move through the spaces between the plates. The dust and other particles become charged at a different polarity than the electrode plates, whereby the charged particles are attracted to and collected on the electrode plates. Periodically the plates are cleaned, for example by shaking the plates, and the collected particulates are removed from the bottom of the precipitator.

One form of plate construction illustrated in FIG. 1 consists of a plurality of individual panels, the edges of which are bent into flanges which are interlocked with the flanges at the edges of adjacent panels. These interlocking flanges form outwardly projecting ribs 22 which extend vertically along the length of the collector plates. In addition to joining the individual panels into an electrode plate, the ribs 22 provide rigidity to the assembled plates enabling the plates to better maintain a flat parallel relationship with respect to the horizontally spaced adjacent plates.

It is desirable that as high a voltage as possible be applied across the electrode plates and corona electrode wires to collect particles passing between the plates more efficiently. It is therefore critical to maintain a constant horizontal spacing between neighboring plates, and in particular a constant spacing between the plates and the corona electrode wires extending therebetween, in order to prevent arcing between the wires and the plates and the subsequent destruction of the electrostatic field produced for collecting the dust particles. If a constant spacing cannot be maintained, the operating voltage must be reduced in order to prevent arcing with an attendant reduction in precipitation efficiency.

Precipitators having the particular collector electrode plate and corona electrode wire configuration described above, sometimes experience a serious problem of plate warping or bowing. Plate warping can occur during the life of the precipitator for a variety of reasons including cleaning (i.e., shaking) of the plates and the high temperature of the combustion gases passing over the plates. Plate warping seriously distorts the spacing between the electrode plates and the electrode wires and increases the danger of arcing, thereby necessitating a lower applied voltage and consequently resulting in a lower precipitation efficiency.

In order to eliminate or at least reduce plate warpage, various plate spacers and methods have been developed. A number of references disclose the use of spacer bars and/or cross braces which extend between adjacent plates in order to maintain interplate spacing. The great majority of these spacers are attached to one or more of the electrode plates, usually by welding. These braces extend horizontally between adjacent plates and provide sufficient strength and rigidity to maintain the plates in their spaced parallel relationship. Various types of these plate spacers are shown in U.S. Pat. Nos. 4,007,023; 4,239,514; 4,519,818; 4,478,614; and 4,479,813. Unfortunately, the installation of these kinds of spacers on existing electrostatic precipitators is extremely expensive and time consuming. A workman must enter between the spaced plates to mechanically attach the spacer to the plates, typically by welding, bolting or similar attachment procedure. This procedure can only be performed after the precipitator has been completely shut down and cooled since much of the supporting hardware for the plates and the corona wires must be removed in order to allow a workman sufficient space in which to work. This increases considerably the "down time" of the precipitator as well as the labor costs associated with the plate straightening procedure.

In response to these difficulties. Ahern in U.S. Pat. No. 4,559,064 developed a spacer comprising a rigid frame which slidably engages the vertically extending ribs on adjacent electrostatic precipitator plates. When a precipitator is new, the Ahern spacers can be installed without the necessity of a workman entering into the restricted space between adjacent plates. The frames are mounted over the ribs adjacent electrode plates, either at the top or the bottom of the precipitator, and slide along the ribs until reaching the desired vertical location within the precipitator. The frames clamp onto the ribs thereby enabling a workman standing outside the precipitator, using a long-handled tool, to slide the spacers into position between the plates purportedly without dismantling the precipitator.

Unfortunately, the Ahern spacers cannot be so easily installed on certain precipitators. For example on many precipitators of the above-described type, dimples are formed along the ribs in order to provide better interlocking between adjacent panels in a plate assembly. The Adhern spacers will not easily slide over these dimples. It is also not uncommon to encounter precipitator plates with ribs which have been crimped. Precipitator servicemen have in the past had modest success in straightening moderately bowed plates by crimping the ribs on the convex side of a bowed plate at spaced intervals along the rib. The Ahern spacer will not slide over the crimps introduced from such plate straightening attempts. In precipitators having severely warped plates, the plate warpage can cause the ribs to deform. The Ahern spacers will not easily slide over these deformed areas.

Accordingly, there has been a need in the art for an improved electrostatic precipitator plate which may be installed at any desired vertical position along the length of the collector electrode plates without requiring dismantling of the electrostatic precipitator and without requiring the spacer to be vertically positioned within the precipitator by sliding the spacer over a long vertical length of the collector plate ribs.

It is another object of the present invention to provide such an electrostatic precipitator plate spacer which is inexpensive and yet effective in maintaining the plates in a predetermined spaced relationship.

It is another object of the present invention to provide an improved plate spacer for electrostatic precipitators which can be installed from the side or from the top of the precipitator plates without requiring removal of the electrode supporting structure and which can be easily positioned at any desired position within the precipitator without requiring the installer to physically enter the space between the plates.

It is another object of the invention to provide such a plate spacer which does not need to be permanently attached to the plates but which instead can be positioned securely at any desired vertical position within the precipitator simply by compressively engaging the projecting ribs formed by the interlocking connection of adjacent collector panel edges.

It is yet another object of the present invention to provide an improved plate spacer which can be easily disengaged from the plates and repositioned at a different location along the plate ribs, either at the time of installation or after the spacer has been installed for a length of time in order to maintain parallel alignment of the horizontally spaced electrode plates throughout the vertical length thereof, and in which more than one spacer can be installed at desired locations along the length of the spaced plates in the event that plate warpage is serious enough to require a plurality of such spacers at various locations.

Another important object of the invention is to provide an improved plate spacer which can be rapidly installed in existing precipitators, thereby reducing the down time of the precipitator during spacer installation.

SUMMARY OF THE INVENTION

These and other important objects are met by the improved plate spacer of the present invention, and method of installing same, which is effective for maintaining a pair of electrostatic precipitator plates in a horizontally spaced relationship. The precipitator plates are of the type having a generally planar vertically extending surface spaced horizontally from and extending parallel with the planar surface of an adjacent plate and having vertically extending ribs projecting perpendicularly from the planar surface toward a rib on an adjacent plate. The spacer comprises a rotatable brace which extends horizontally between an adjacent pair of precipitator plates at their vertically extending ribs. Each end of the brace is provided with an open groove having a width that is substantially equal to slightly less than the thickness of the ribs so that the ends of the spacer compressively engage the vertically extending ribs.

From an ease of manufacturing standpoint, the spacer preferably comprises a pair of braces which are spaced apart a distance substantially equal to slightly less than the thickness of the ribs to form an open groove or space therebetween, so that the spacer can compressively engage the vertically extending ribs therein. Each of the pair or braces has two plate engaging edges, the edges being at opposite ends of the brace. The braces each have a width which is substantially equal to the interplate spacing so that each of the plate engaging edges abuts against one of the pair of adjacent precipitator plates when the spacer is positioned horizontally between the plates. The braces each have a height which is less than, and preferably at least 20% less than the horizontal spacing between oppositely projecting ribs on adjacent plates (i.e., the inter-rib spacing). This allows the spacer to be freely moved into the desired mounting position within an electrostatic precipitator without clampingly engaging the ribs. The brace also has at least one diagonal dimension which is no more than about 3% greater than the horizontal interplate spacing. In this way, the rotation of the brace between adjacent plates will cause the plates to be momentarily displaced no more than about 3% of the horizontal interplate spacing. The plate engaging edges must have a length that is at least about 25% of the horizontal interplate spacing and preferably at least about 33% of the horizontal interplate spacing in order to impart the necessary stability to the spacers. The braces are preferably open-faced to allow free flow of gases therethrough.

In preferred embodiment of the present invention, the braces have at least one angled mounting edge contiguous with one of the plate engaging edges. The interior angle formed between the contiguous angled edge and plate engaging edge must be greater than about 110° and is preferably in the range of about 120° to 135°.

The present invention also includes a method of mounting the above-mentioned spacer between a pair of adjacent electrostatic precipitator plates in order to maintain the plates in a horizontally spaced relationship. The method includes the steps of orienting the spacer between adjacent plates so that at least one, and preferably both, of the pair of adjacent plate ribs extends into the open grooves provided at the ends of the brace. The spacer is oriented so that the edges of the brace which define the diagonal dimension, which diagonal dimension is no more than about 3% greater than the horizontal interplate spacing, engage the adjacent facing plate surfaces. The spacer is then rotated until the plate engaging edges abut against the adjacent plates with the ribs positioned in the open spaces or grooves. This installation method allows the spacer to be positioned within the precipitator by accessing the side of the precipitator plates.

An alternate spacer mounting method allows the spacer to be positioned by lowering the spacer from the top of the precipitator. The spacer is guided into the desired vertical mounting position by freely sliding the spacer along the ribs without the spacer frictionally clamping the ribs. Once in the desired mounting position, the spacer is then simply rotated until it locks into place on the collecting electrode plate ribs as described above.

DETAILED DESCRIPTION OF THE INVENTION

Figure 1:
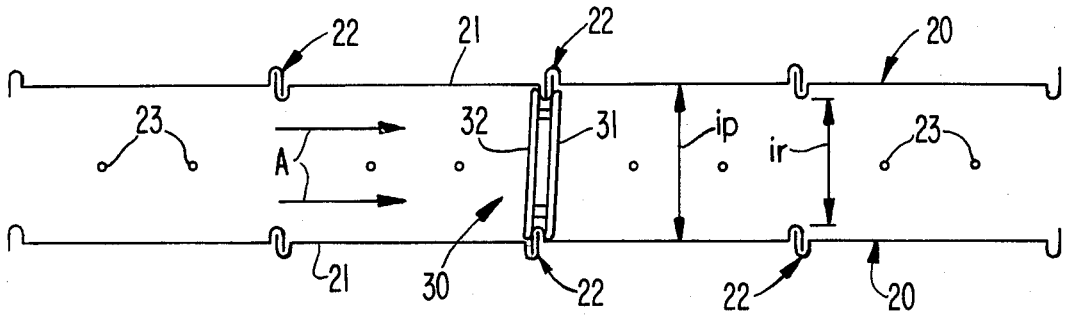
FIG. 1 is a top plan view of two adjacent and parallel collector electrode plates in an electrostatic precipitator, the plates having installed therebetween a spacer of the kind shown in FIGS. 2 and 3, the spacer compressively engaging the plate ribs.

Referring to the drawings wherein like reference numerals refer to like elements in the several drawings, and especially referring to FIG. 1, there is shown a top view of an adjacent set of electrostatic precipitator plates 20, each plate 20 being formed by a plurality of individual collector plate panels 21 which are joined together along their edges by interlocking flanges which form outwardly extending ribs 22. Typically, ribs 22 have a thickness of about $\frac{1}{8}$ to 3/16 inch and project out from the plate 20 surface a distance of about $1\frac{1}{2}$ inches. Accordingly, the inter-rib spacing ir is about 3 inches less than the interplate spacing ip.

A plurality of corona electrode wires 23 are suspended from a suitable support means (not shown) so that the wires 23 extend downwardly between plates 20 equidistance between adjacent plates 20. As is known to those skilled in the art, the distance between a wire 23 and a plate 20 (i.e., distance $\frac{1}{2}$ip) must be less than the distance between a wire 23 and a spacer 30. Otherwise, arcing will occur between the wire 23 and the spacer 30, reducing precipitator efficiency.

Figure 2:
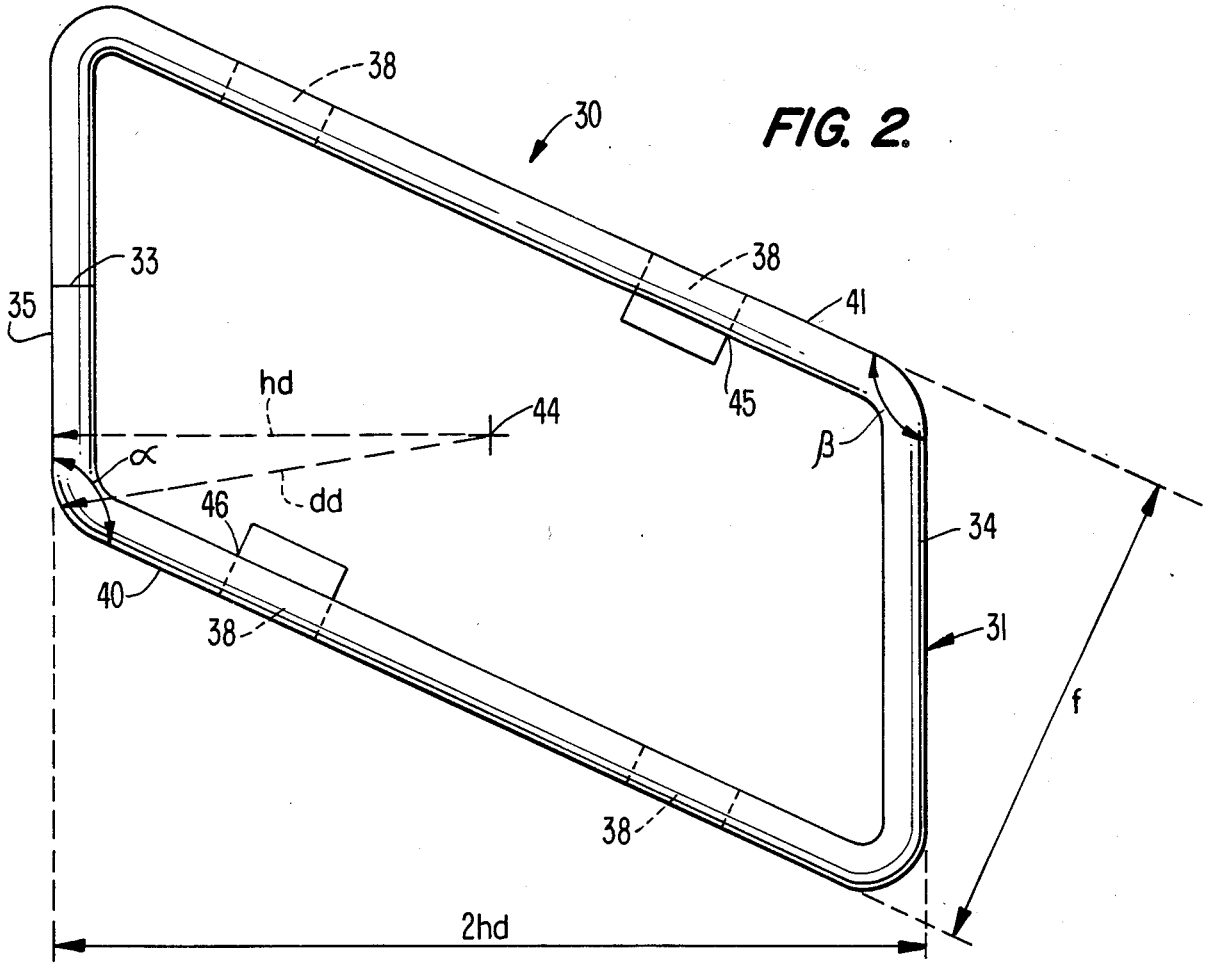
FIG. 2 is a side view of an electrostatic precipitator plate spacer according to one embodiment of the present invention.
Figure 3:
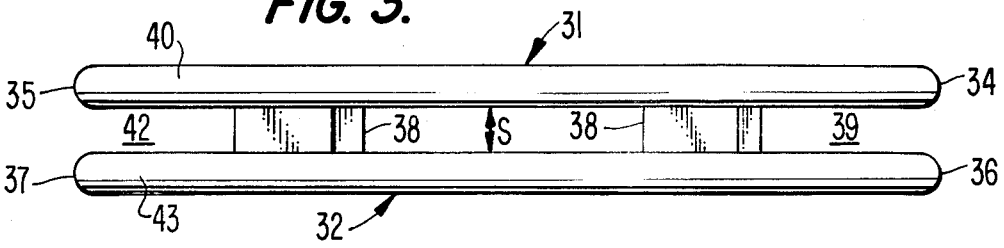
FIG. 3 is a bottom view of the spacer shown in FIG. 2.

Referring now to FIGS. 2 and 3, one form of the improved plate spacer is indicated generally at 30 and includes a pair of parallelogram-shaped braces 31 and 32. Both braces 31 and 32 are preferably formed by bending steel bars having a circular cross-section and a typical diameter of about $\frac{1}{4}$ inch into the illustrated parallelogram shape. Those skilled in the art will appreciate that bars having other than a circular cross section may also be used. Braces 31 and 32 are substantially the same size and shape. The ends of the bar forming brace 31 (as well as the ends of the bar forming brace 32) may be spliced together to form a splice joint 33, e.g. by welding. Braces 31 and 32 each have a geometric center which falls on a rotational axis 44 which is oriented perpendicularly to the plane of the drawing.

Braces 31 and 32 are attached to one another in a spaced apart relationship by welding a plurality of spacing bars 38 between the braces 31 and 32. The thickness of bars 38 should be substantially equal to slightly less than the thickness of ribs 22 on plates 20. In this way, braces 31 and 32 are maintained in a spaced relationship, the spacing S between braces 31 and 32 being substantially equal to slightly less than the thickness of ribs 22. Typically, spacing S is on the order of about $\frac{1}{8}$ inch. Spacing bars 38 are positioned a distance inwardly from the outer ends of spacer 30 thereby leaving an open space or groove 39 between the pair of plate engaging edges 34 and 36 and an open space or groove 42 between the pair of plate engaging edges 35 and 37. When the spacer 30 is installed between electrostatic precipitator plates 20, ribs 22 extend into open spaces or grooves 39 and 42 as is best shown in FIG. 1. The spacer 30 is held in place between the adjacent pair of ribs 22 by compressing the projecting ribs 22 between the ends of braces 31, 32, i.e. by a compressive frictional fit. Preferably, the thickness of the spacing bars 38 is slightly less than the thickness of ribs 22 in order to ensure a tight compressive frictional fit of the ribs 22 between braces 31, 32.

An important advantage of the plate spacers of the present invention over the prior art spacers concerns the ease with which they are installed between a pair of adjacent electrostatic precipitator plates. To facilitate the mounting of spacer 30 between a pair of adjacent ribs 22, and angled mounting edge 40 is provided on one side of spacer 30, the angled edge 40 being contiguous with plate engaging edge 35. In order to satisfy the objectives of the present invention, the diagonal distance dd between axis 44 and the corner formed between edges 35 and 40 must be not more than about 3% greater than the distance hd along a horizontal plane between axis 44 and edge 35 (which distance is about one-half the horizontal interplate spacing, i.e., hd≅$\frac{1}{2}$ip.). In order to satisfy this relationship with the parallelogram-shaped spacer 30, the internal angle alpha between edge 35 and edge 40 must be greater than about 110°. Brace 32 has a size and shape identical to brace 31, and accordingly has the same angles and spacing relationships discussed above. On the opposite end of spacer 30, brace 31 has a second angled edge 41 which is contiguous with edge 34. Contiguous edges 34 and 41 form a corner of brace 31 that is diagonally opposite the corner formed by contiguous edges 35 and 40. The interior angle beta between edges 34 and 41 is also greater than about 110° and the diagonal distance between axis 44 and the corner formed between edges 34 and 41 is at most only about 3% greater than the horizontal distance between axis 44 and edge 34. Accordingly, spacer 30 has a diagonal dimension which is defined as the distance between the corner between edges 35 and 40 and the corner between edges 34 and 41. This diagonal dimension is equal to 2dd, and furthermore is at most only about 3% greater than the horizontal interplate spacing, ip.

In the parallelogram-shaped configuration illustrated in FIG. 2, angle alpha is equal to angle beta and both angles are preferably 120°. The corner of brace 31 formed by edges 35 and 40 is preferably rounded as shown in FIG. 2. Similarly, the corners formed by the pairs of edges 34 and 41, 37 and 43 and 36 and its contiguous angled edge (not shown) are also preferably rounded. In order to provide spacer 30 with sufficient stability to withstand the rigors of operation and cleaning, the length of each of edges 34, 35, 36 and 37 should be at least 25% of the horizontal interplate spacing ip and preferably about 33% of the horizontal interplate spacing ip.

In order to allow spacer 30 to be freely moved into the desired mounting location with the electrostatic precipitator, the spacer 30 has a height f which is less than the horizontal spacing between the tips of ribs 22 on adjacent plates 20. This inter-rib spacing is distance ir in FIG. 1.

In order to install spacer 30 between an adjacent pair of ribs 22, the spacer 30 is oriented with its length (i.e., the dimension having a length of about 2hd) in an approximately vertical direction so that the spacer 30 may be easily moved into the desired installation location between the adjacent plates 20 without contacting plates 20 and without compressively engaging ribs 22. Once the spacer 30 is at the desired location between a pair of ribs 22, the spacer 30 must be oriented so that one of a pair of oppositely projecting ribs 22 extends into one, and the second of the pair of oppositely projecting ribs 22 extends into the other, of open grooves or spaces 39 and 42 provided at opposite ends of spacer 30. After proper orientation, the spacer 30 is simply rotated in a counterclockwise direction, as viewed from the vantage point shown in FIG. 2 (from the opposite side of spacer 30, the rotation is in a clockwise direction), about axis 44 until it "locks" into place between adjacent plates 20 with the plate engaging edges 34 and 35 abutting against the opposite plates 20. In the locked-in position, the plate engaging edges 34 and 36 abut against one of the pair of adjacent plates 20 while the plate engaging edges 35 and 37 abut against the other of the pair of plates 20. One of the plate ribs 22 extends into space 39 while the opposite rib 22 extends into space 42. The spacer 30 is securely held between the plates 20 because braces 31 and 32 compressively and frictionally engage the ribs 22 therebetween.

The spacer 30 may be rotated about axis 44 in a number of ways. In one method, the spacer 30 is releasably mounted on the end of a long handled tool. A workman standing at the side of the precipitator plates extends the tool, with the spacer 30 mounted thereon, between adjacent plates 20 to a desired mounting location between oppositely projecting ribs 22. The spacer 30 is rotated into the locked-in position between plates 20 simply by rotating the tool. An alternate method of mounting the spacer 30 involves two workmen, one above and one below the precipitator plates 20. The workman above the precipitator plates lowers the spacer 30 by means of a rope. The rope may be looped through spacer 30 at location 45. The spacer 30 moves downwardly without clampingly engaging ribs 22 but being guided by the tips of the ribs, the tips having a thickness which is less than the thickness of the ribs themselves. The second workman positioned below the precipitator plates assists the downward movement by employing a second rope which may be looped through spacer 30 at location 46. When the spacer 30 is at the desired mounting position, the spacer 30 is rotated into a locked position by means of the two workmen pulling on each of the ropes.

By providing a parallelogram-shaped spacer 30 having a diagonal dimension 2dd that is no more than about 3% greater than the horizontal interplate spacing ip, the twisting of the spacer 30 in order to lock it into its final position is greatly facilitated since the displacement of the plates 20 during rotation of spacer 30 is minimized. This is important in achieving the objectives of the present invention, one of which is to be able to mount spacer 30 without disassembling the electrostatic precipitator and without having to slide the spacer 30 over an extended length of vertical rib while the spacer clampingly engages the rib.

In order to ensure that the spacer 30 can be easily moved between adjacent plates 20 while mounted on the end of a long handled tool, the height of spacer 30 which is shown as distance f in FIG. 2 must be less than the inter-rib spacing ir and preferably at least 20% less than the inter-rib spacing ir.

Figure 4:
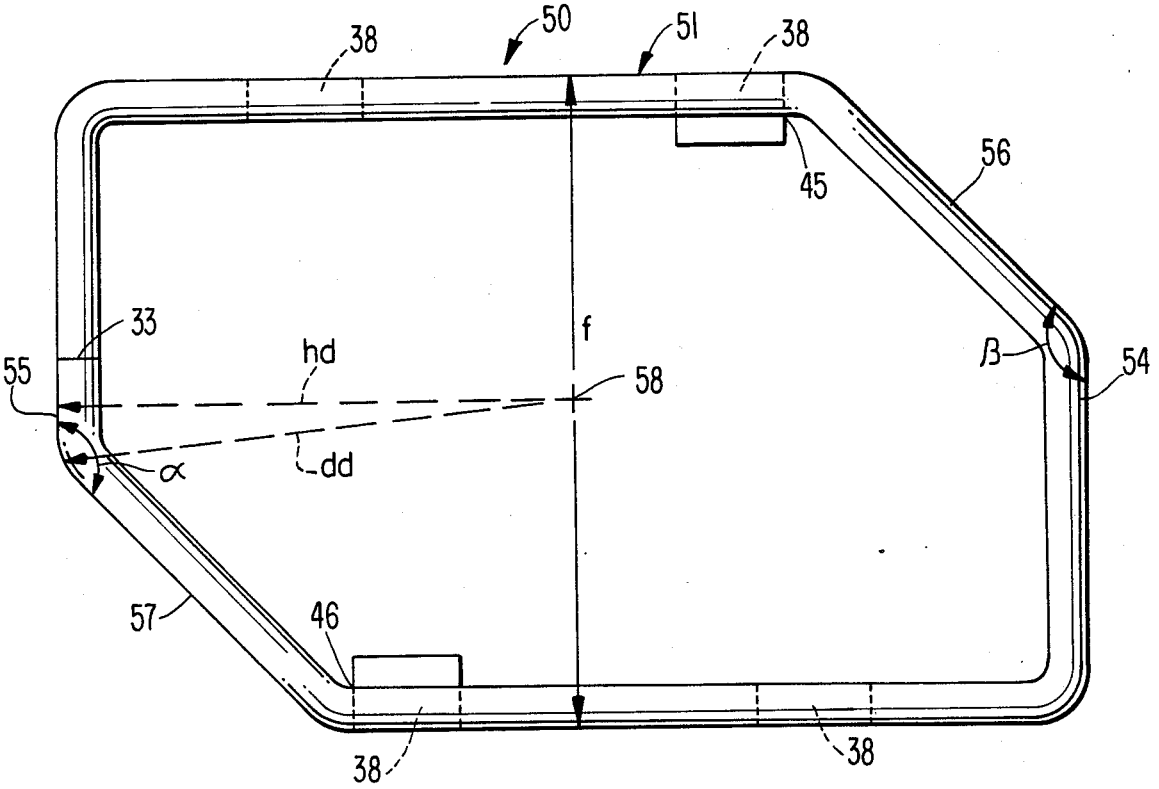
FIG. 4 is a side view of an electrostatic precipitator plate spacer according to another embodiment of the present invention.

FIG. 4 illustrates another embodiment of a spacer according to the present invention. Spacer 50 comprises two identically sized and shaped braces 51 and 52 (not shown). The braces 51 and 52 are formed by bending a steel bar having a circular cross-section and a diameter of about ¼ inch into the illustrated configuration. Bars having other cross sectional shapes may also be used. Braces 51 and 52 are attached to one another by welding spacing bars 38 between the braces 51, 52. As in the earlier embodiment, the spacing bars 38 have a thickness substantially equal to slightly less than the thickness of ribs 22 on plates 20. Braces 51 and 52 have a geometric center which falls on a rotational axis 58 which is oriented perpendicularly to the plane of the drawing. Brace 51 has a substantially rectangular configuration with the exception of two angled edges 56 and 57.

In order to satisfy the objectives of the present invention, the diagonal distance dd between axis 58 and the corner is at most only about 3% greater than the horizontal distance hd between axis 58 and edge 55. Similarly, the diagonal distance between axis 58 and the corner formed between edges 54 and 56 is at most only about 3% greater than the horizontal distance between axis 58 and edge 54. Thus, the diagonal dimension of the spacer 50, equal to 2dd, is at most only about 3% greater than the horizontal interplate spacing (i.e., ip or 2hd). This ensures that as spacer 50 is rotated between adjacent plates 20, the displacement of plates 20 during rotation is minimized. Spacer 50 is provided with edges 54 and 55 each having a length that is at least about 25% and preferably 33% of the interplate spacing ip. The horizontal internal angle alpha between plate engaging edge 55 and angled edge 57 is greater than about 110° and preferably is about 135°. The internal angle beta between angled edge 56 and plate engaging edge 54 is, in the illustrated embodiment, equal to angle alpha. Spacer 50 can be mounted on an adjacent pair of ribs 22 in substantially the same ways as the previously described mounting methods for spacer 30. The height f of spacer 50 is less than, and preferably at least 20% less than, the inter-rib spacing ir for the reasons previously described.

Both spacers 30 and 50 present a substantially open configuration, as best shown in FIGS. 2 and 4, respectively, in order to minimize interference with the particulate containing gases flowing between precipitator plates 20. The dust laden gases typically flow in the direction of arrows A in FIG. 1 and accordingly the gases flow directly through the open faces of spacers 30 and 50 thereby minimizing the pressure drop across the precipitator.

Figure 5:
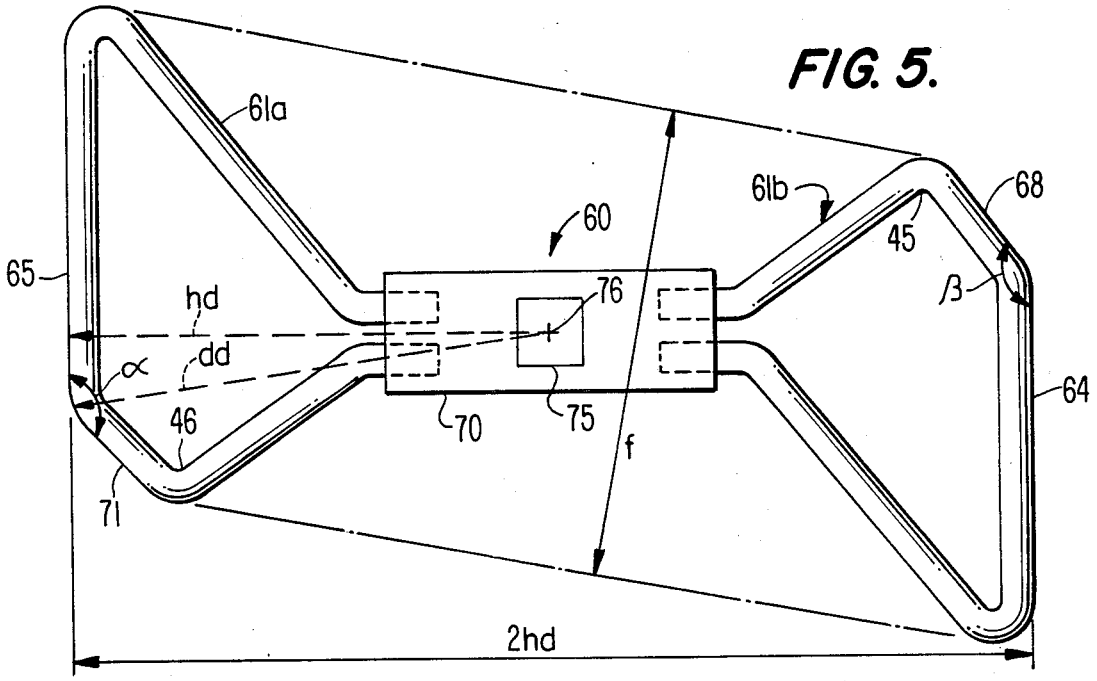
FIG. 5 is a side view of an electrostatic precipitator plate spacer according to another embodiment of the present invention.
Figure 6:
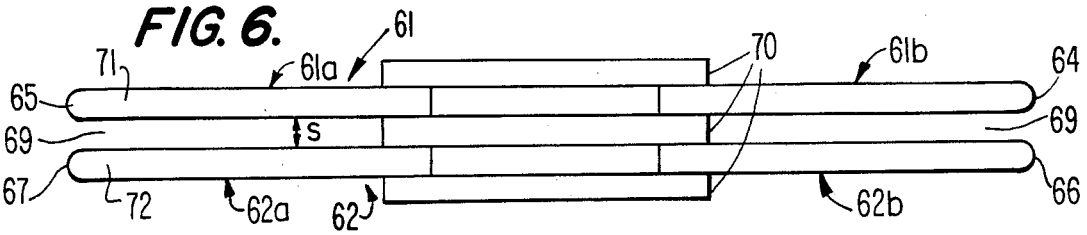
FIG. 6 is a bottom view of the spacer illustrated in FIG. 5.

Referring now to FIGS. 5 and 6, there is shown another embodiment of an electrode spacer according to the present invention. Spacer 60 comprises a pair of braces 61, 62 each of the braces having two sections (a and b) joined in the middle by a plurality of sandwiching support plates 70. The brace portions 61*a*, 61*b*, 62*a* and 62*b* are formed by bending a steel bar having a circular cross-section and a diameter of about 174 inch into the illustrated configurations. Bars having other cross sectional shapes may also be used. As in the earlier embodiments, brace 61 has a pair of plate engaging edges 64 and 65 at opposite ends of spacer 60. Similarly, brace 62 has a pair of plate engaging edges 66 and 67 at opposite ends of spacer 60. Brace portions 61*a*, 61*b*, 62*a*, and 62*b* are each welded to a central spacing plate 70. Spacing plate 70 has a thickness substantially equal to slightly less than the thickness of ribs 22. This provides open spaces or grooves 69 at the opposite ends of spacer 60. When the spacer 60 is positioned between electrostatic precipitator plates 20, the ribs 22 extend into the open spaces 69 and are compressed between the ends of the braces 61, 62. Preferably, two additional outer plates 70 are provided and welded onto braces 61 and 62 to provide additional torsional stability to spacer 60.

In order to satisfy the objectives of the present invention, the diagonal distance dd of spacer 60 is at most only about 3% greater than the horizontal distance hd. Accordingly, the diagonal dimension of spacer 60 (i.e., 2dd) is at most only 3% greater than the horizontal interplate spacing (i.e., ip or 2hd). Thus, when spacer 60 is rotated about axis 76, the displacement of plates 20 is minimized. The lengths of edges 64, 65, 66 and 67 are at least about 25% of the horizontal interplate spacing ip and preferably at least about 33% of the horizontal interplate spacing ip. The internal angle alpha between contiguous edges 65 and 71 is greater than about 110°, and is preferably about 135°. A similar angled edge 72 is provided contiguous with edge 67 on brace 62. The internal angle between edges 67 and 72 is equal to angle alpha. In addition, an angled edge 68 is provided contiguous with plate engaging edge 64 on brace 61. The internal angle beta between edge 64 and edge 68 is at least about 110° and is preferably about 135°. A similar contiguous angled edge (not shown) is provided contiguous with edge 66 on brace 62 forming an angle therewith equal to angle beta. The height f of spacer 60 is less than, and is preferably at least 20% less than, the inter-rib spacing ir as described above.

A desired optional feature of spacer 60 comprises the keyhole 75. Keyhole 75 comprises a square opening through at least one, but preferably all of the plates 70. Preferably the center of keyhole 75 falls on the rotational axis 76 of spacer 60. In order to install spacer 60 at a desired location within an electrostatic precipitator, spacer 60 is simply mounted on the male end of an elongated rod or similar tool, the end of the rod having a square cross-section of the same size and shape as keyhole 75, by inserting the square end into keyhole 75. The elongated tool can be used to position and mount spacer 60 within the electrostatic precipitator, the rod is simply rotated in a counterclockwise direction until spacer 60 locks into place with ribs 22 from adjacent electrode plates extending into open spaces 69 and the rib engaging edges 64, 65, 66 and 67 abutting flat against the adjacent electrode plates 20. The end of the rod is then simply pulled out of the keyhole 75 while spacer 60 remains in position compressing ribs 22 between braces 61 and 62.

Figure 7:
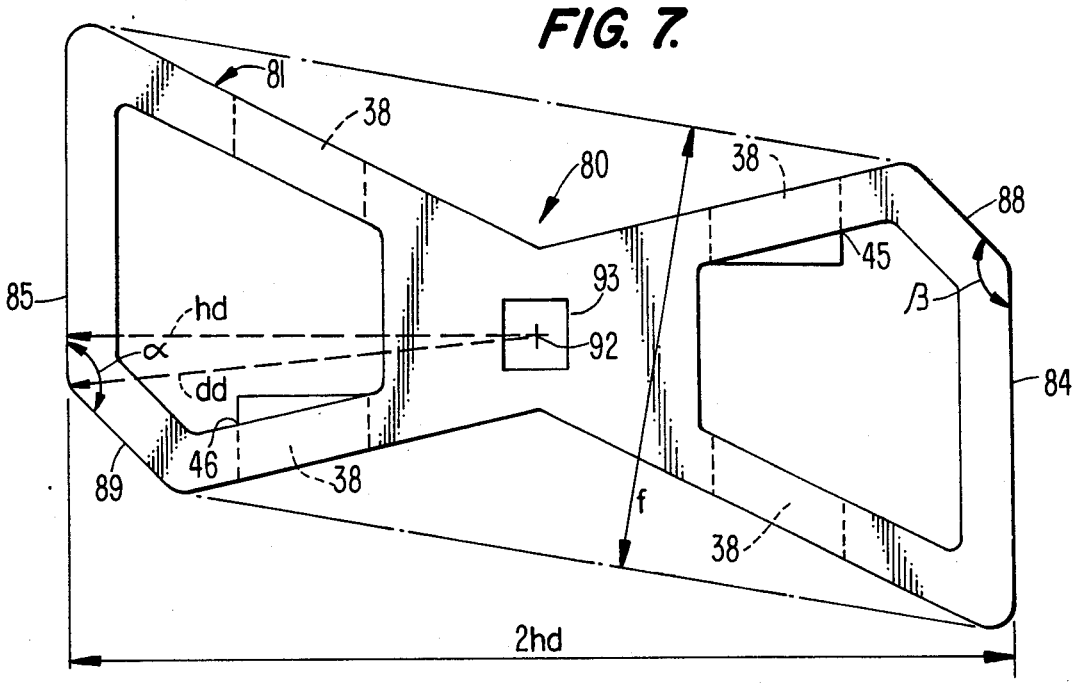
FIG. 7 is a side view of an electrostatic precipitator plate spacer according to another embodiment of the present invention.
Figure 8:
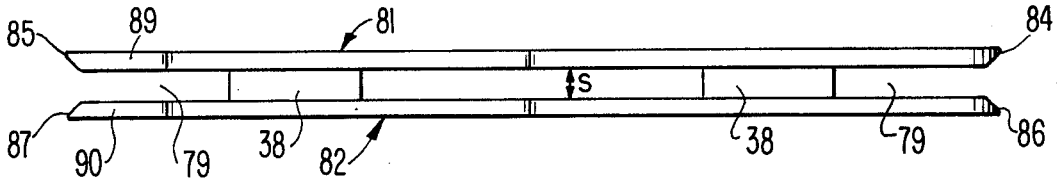
FIG. 8 is a bottom view of the precipitator plate spacer shown in FIG. 7.

Referring now to FIGS. 7 and 8 there is shown another embodiment of a spacer according to the present invention. Spacer 80 comprises a pair of spaced braces 81, 82. Each of the braces 81, 82 is formed from a steel plate having a thickness of about 0.13 inch (i.e., about 10 gauge) and having the shape illustrated in FIG. 7. Braces 81 and 82 are attached to one another by welding a plurality of spacing bars 38 between braces 81, 82 as in the other spacer embodiments. Accordingly, the braces 81 and 82 are spaced a distance S apart from one another, the distance S being approximately equal to slightly less than the thickness of an electrode rib 22. Brace 81 has two plate engaging edges 84, 85 at opposite ends thereof. Similarly, brace 82 has a pair of plate engaging edges 86, 87 also at opposite ends thereof.

The geometric center for each of braces 81, 82 falls on rotational axis 92. As in the other spacer embodiments, the diagonal distance dd is at most only about 3% greater than the horizontal distance hd. Accordingly, the diagonal dimension of spacer 80 (i.e., 2dd) is at most only 3% greater than the horizontal interplate spacing (i.e., ip or 2hd). Edges 84, 85, 86 and 87 are each at least about 25% and preferably 33% of the horizontal interplate spacing. The internal angle beta between contiguous edges 84 and 88 is at least 110° and is preferably about 135°. Similarly, an angled edge 89 is provided contiguous with plate engaging edge 85. The internal angle alpha between edges 85 and 89 is also greater than about 110° and is preferably about 135°. Similarly, in brace 82 an angled edge 90 is provided contiguous with plate engaging edge 87. The internal angle between edges 87 and 90 is the same as angle alpha. An angled edge (not shown) is provided contiguous with plate engaging edge 86. The internal angles between edge 86 and the contiguous angled edge is the same as angle beta. The height f of spacer 80 is 20% less than, the inter-rib spacing ir as described above. A keyhole 93 is provided in the center of space 80. Keyhole 93 has the same function as keyhole 75 illustrated in FIG. 5. As is clearly shown in FIG. 8, each of the braces 81 and 82 has a rectangular cross-section.

Figure 14:
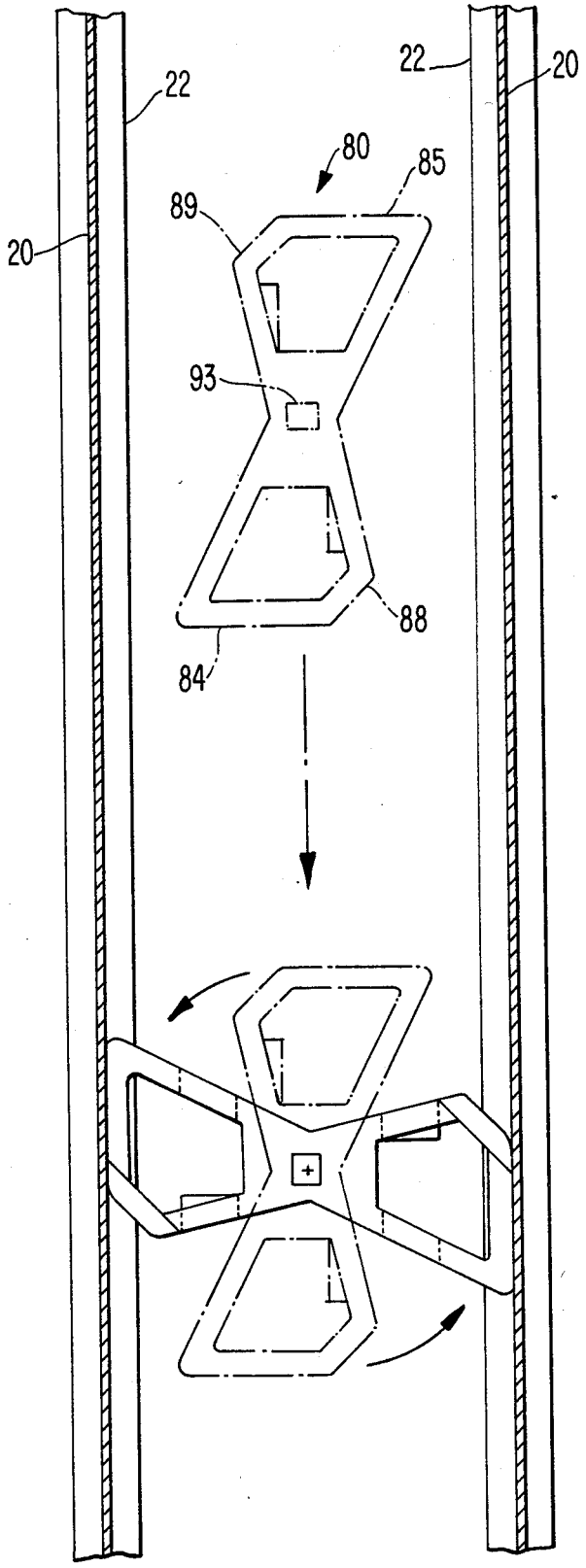
FIG. 14 is a side view, with parts shown in section and other parts shown in phantom, showing the positioned and mounting of a spacer between adjacent parallel plates.

When installing spacer 80 between an adjacent pair of ribs 22, the spacer 80 is oriented with its length (i.e., the dimension having a length of about 2hd) in an approximately vertical direction so that the spacer 80 may be easily moved into the desired installation location between the adjacent plates 20 without contacting plates 20 and without compressively engaging ribs 22. Reference may be made to FIG. 14 which illustrates the positioning and mounting method. Once the spacer 80 is at the desired location between a pair of ribs 22, the spacer 80 is rotated until one of the pair of oppositely projecting ribs 22 extends into one, and the second of the pair of oppositely projecting ribs 22 extends into the other, of open grooves or spaces 79 provided at opposite ends of spacer 80. After proper orientation, the spacer is positioned so that edges 88 and 89 are substantially abutting against the adjacent plates 20. The spacer 80 is then further rotated in a counterclockwise direction about axis 92 until it "locks" into place between adjacent plates 20 with the plate engaging edges 84 and 85 abutting against the opposite plates 20. In the lock-in position, the plate engaging edges 84 and 86 abut against one of the pair of adjacent plates 20 while the plate engaging edges 85 and 87 abut against the other of the pair of plates 20. The spacer 80 is securely held between the plates 20 because braces 81 and 82 compressively and frictionally engage the ribs 22 therebetween.

The spacer 80 may be vertically positioned and rotated about axis 92 by releasably mounting the spacer 80 on the end of a long handled tool, the tool having an end which fits into keyhole 93. A workman standing at the side of the precipitator plates extends the tool, with the spacer 80 mounted thereon, between adjacent plates 20 to the desired mounting location between oppositely projecting ribs 22. The spacer 80 is rotated into the locked-in position between plates 20 simply by rotating the tool.

In order to facilitate the mounting of spacer 80 onto oppositely projecting ribs 22, the interior portions of edges 84, 85, 86, 87, 88, 89, 90 and the angled edge contiguous with edge 86 (not shown) are preferably beveled. Beveling of edges 84, 85, 86, and 87 assures that the edges will abut properly up against plates 20 if there is a slight radius at the junctures between the individual plate panels 21 and their interconnected ribs 22. Beveling of edges 88, 89, 90 and the angled edge contiguous with edge 86 (not shown) makes it easier for a workman to move the spacer 80 into the desired mounting position, either when installed with a long handled tool, or when the spacer 80 is lowered from the top of the precipitator using ropes. In either case, beveling of edges 88, 89, 90 and the angled edge contiguous with edge 86 (not shown) allow spacer 80 to be slid over an extended length of ribs 22 without clampingly engaging the ribs 22. Since the ribs 22 can be positioned between the beveled portions of edges 88–90 and the edge contiguous with edge 86 during vertical positioning, without fully extending into open spaces 79, there is no clamping engagement of the ribs. This allows the spacer to be freely moved into the desired vertical position while being guided over the ribs 22.

Figure 9:
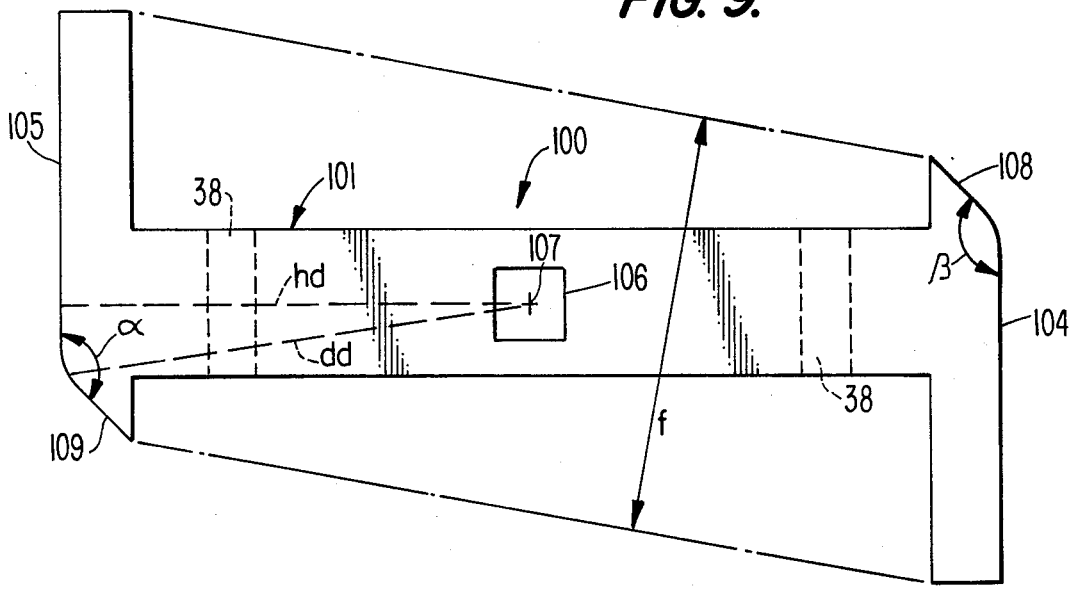
FIG. 9 is a side view of an electrostatic precipitator plate spacer according to another embodiment of the present invention.
Figure 10:
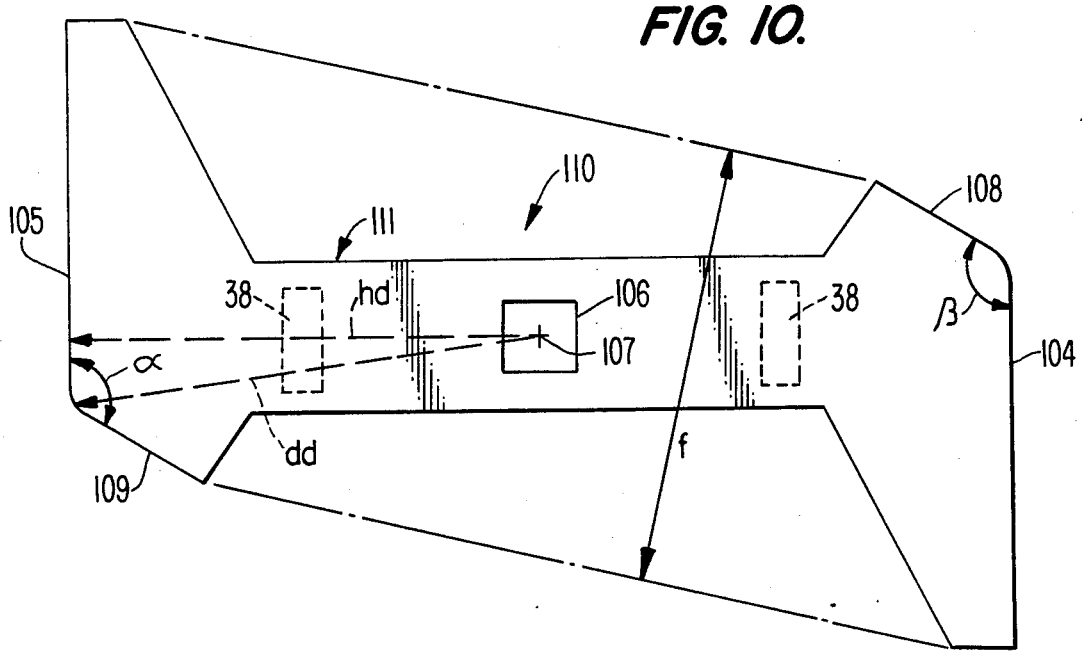
FIG. 10 is a side view of an electrostatic precipitator plate spacer according to another embodiment of the present invention.

FIGS. 9 and 10 illustrate two further embodiments of the spacer of the present invention. Spacer 100 illustrated in FIG. 9 comprises a pair of identically sized and shaped braces 101. Each of the braces 101 is formed from a steel plate having a thickness of about 0.13 inch (10 Ga). The braces 101 are attached to one another by welding two spacing bars 38 therebetween. The geometric centers of each of the braces 101 falls on rotational axis 107. As in the other spacer embodiments, the diagonal distance dd is at most only 3% greater than the horizontal distance hd. The length of each of edges 104, 105 is at least about 25% and preferably 33% of the horizontal interplate spacing (i.e., ip or 2hd). Each of the braces 101 includes two plate engaging edges 104, 105 at opposite ends thereof. Contiguous with edge 104 is an angled edge 108. Contiguous with edge 105 is an angled edge 109. The internal angle alpha between edges 105 and 109 is greater than about 110° and is preferably about 135°. Similarly, the internal angle beta between edges 104 and 108 is at least about 110° and is preferably about 135°. Both spacers 100 and 110 are optionally provided with square keyholes 106 through the spaced plates to allow for easy installation of the spacers using long handled mounting tools as has been described heretofore. Spacers 100 and 110 each have a height f which is less than the inter-rib spacing ir. Since the braces are in the form of plates having a rectangular cross-section, the angled edges 108, 109 and plate engaging edges 104, 105 are preferably beveled along their interior portions which engage the ribs 22.

An alternate construction of spacers 100 and 110 can be made using a single brace 101 having a greater thickness, typically on the order of about ⅜ inches. In these alternate embodiments, no spacing bars 38 are utilized. Accordingly, each of the ends of braces 101 are provided with an open groove to compressively accept the electrode ribs 22 therein. In these embodiments, the ends of the spacers have a generally U-shaped cross section and provide an open groove between the sides of the U.

Figure 11:
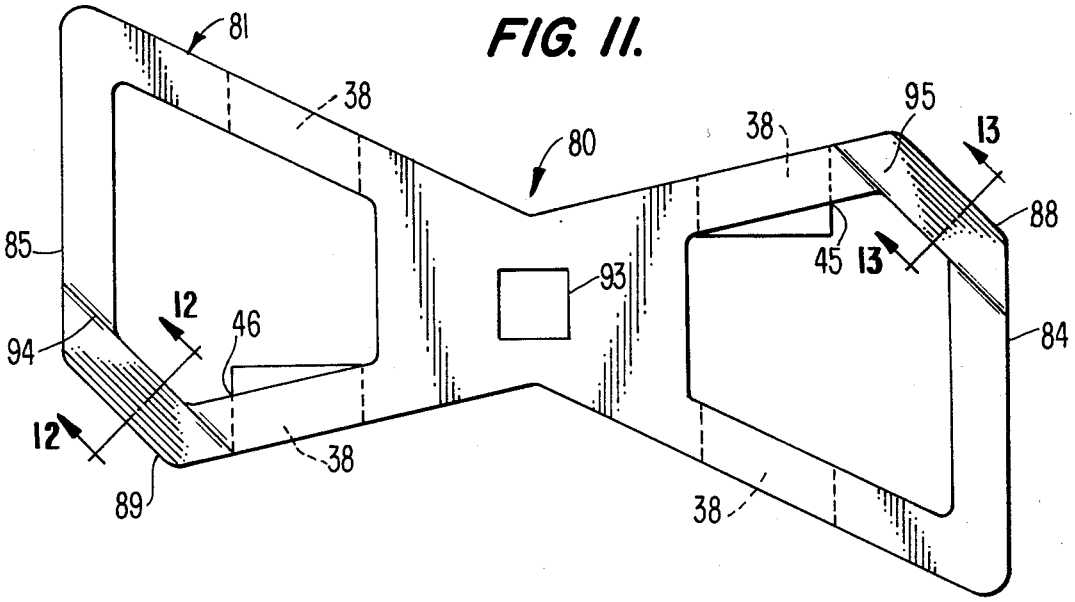
FIG. 11 is a side view of an electrostatic precipitator plate spacer according to another embodiment of the present invention.
Figure 12:
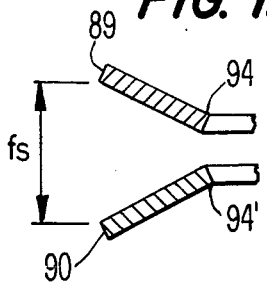
FIG. 12 is a partial sectional view of the plate spacer illustrated in FIG. 11 and taken along line 12—12.
Figure 13:
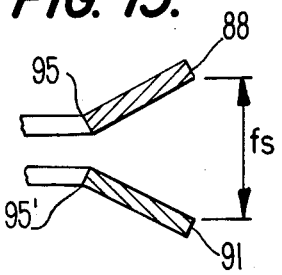
FIG. 13 is a partial sectional view of the plate spacer illustrated in FIG. 11 and taken along line 13—13.

FIGS. 11, 12 and 13 illustrate a modified version of the spacer illustrated in FIGS. 7 and 8. In this embodiment, spacer 80 is provided with flared angled edges 88, 89, 90 and the edge contiguous with edge 86. These edges are flared outwardly by bending brace 81 outwardly along bend lines 94, 95 and by bending brace 82 outwardly along bend lines 94' and 95'. The flared configuration of the angled edges is most clearly illustrated in FIGS. 12 and 13. The flared angle edges 88–90 and the edge contiguous with edge 86 allow easier vertical positioning of the spacer 80 at the desired mounting location within the electrostatic precipitator, prior to rotating the spacer into a locked-in position between oppositely projecting ribs 22 on adjacent plates 20. The flared pairs of edges 88, the edge contiguous with edge 86 and 89, 90 are each separated by a distance fs which is greater than the thickness of ribs 22. Accordingly, the spacer 80 may be positioned on oppositely projecting ribs 22 with the ribs 22 projecting into the spaces between the flared angled edges 88, the edge contiguous with edge 86 and 89, 90. The spacer 80 is then simply lowered down into the precipitator guided by the ribs 22 which remain between the flared edges. During the lowering of the spacer 80, the flared edges do not clampingly engage the ribs since the spacing between the flared edges is greater than the rib thickness. However, by maintaining the ribs 22 within the flared ends, the spacer 80 maintains the proper orientation for later rotationally locking into position between adjacent plates 20. The flared angled edges are especially useful when the ribs 22 have been deformed such as from buckling, or from dimpling or crimping caused by previous attempts to straighten the plates. The angled edges need not be beveled when the spacers have this flared configuration.

Although certain embodiments of the invention have been described and illustrated herein, it will be appreciated by those skilled in the art that a wide variety of equivalents may be substituted for the specific elements of the spacer embodiments described and that the illustrated embodiments are only specific examples of the present invention the scope of which is defined by the appended claims.

We claim:

1. In an electrostatic precipitator having a pair of adjacent precipitator plates, each of said plates having a generally planar vertically extending surface spaced horizontally from and oriented parallel with the planar surface of the adjacent plate, and wherein each of said plates has a vertically extending rib projecting perpendicularly from the planar surface toward a rib on the adjacent plate, the improvement comprising a spacer for maintaining the pair of adjacent precipitator plates in a horizontally spaced relationship, the spacer including:

a brace which extends horizontally between adjacent precipitator plates at the vertically extending ribs thereof, said brace having an open groove at each end thereof, the groove having a width sufficient to compressively engage the vertically extending ribs therein, the brace having two plate engaging edges at opposite ends thereof, each of the plate engaging edges having a length of at least about 25% of the horizontal distance between adjacent precipitator plates and abutting against one of the pair of adjacent precipitator plates when said spacer extends horizonally between said plates, the brace having (i) a diagonal dimension that is no more than about 3% greater than the horizontal interplate spacing between adjacent precipitator plates, and (ii) a height which is less than the horizontal distance between the perpendicularly projecting ribs on the adjacent plates.

2. The precipitator of claim 1 including a pair of identically sized and shaped braces attached to, and spaced apart from, one another, wherein said open groove comprises the open space between the spaced braces.

3. The precipitator of claim 2, wherein the braces are attached to, and spaced apart from, one another by welding a plurality of spacing bars therebetween.

4. The precipitator of claim 3, wherein the spacing bars have a width that is substantially equal to slightly less than the width of the ribs.

5. The precipitator of claim 1 wherein the brace has at least one angled edge adapted to slidably engage the planar surface of the plate when the spacer is positioned for mounting, the angled edge being contiguous with one of said plate engaging edges, the internal angle formed between the contiguous angled edge and the plate engaging edge being greater than about 110°.

6. The precipitator of claim 5, wherein the internal angle formed between the contiguous angled edge and the plate engaging edge is about 120°.

7. The precipitator of claim 5, wherein the internal angle formed between the contiguous angled edge and the plate engaging edge is about 135°.

8. The precipitator of claim 5, wherein the angled edge is beveled.

9. The precipitator of claim 5, wherein the angled edge is flared.

10. The precipitator of claim 1, wherein the brace is formed from a metal rod having a circular cross section.

11. The precipitator of claim 1, wherein the brace is formed from a metal plate having a rectangular cross section.

12. The precipitator of claim 1, wherein the brace has faces which are substantially open to allow free flow of gases therethrough.

13. The precipitator of claim 1, wherein the brace has a keyhole positioned midway between the adjacent plates when the brace is mounted horizontally therebetween, said keyhole being adapted to engage with the male end of a rotatable spacer mounting tool.

14. The precipitator of claim 13, wherein the keyhole is centered about a rotational axis of said spacer.

15. The precipitator of claim 1, wherein each of the plate engaging edges has a length of at least about 33% of the horizontal distance between adjacent precipitator plates.

16. The precipitator of claim 1, wherein the height of the spacer is at least 20% less than the distance between the perpendicularly projecting ribs on the adjacent plates.

17. The precipitator of claim 1, wherein the plate engaging edges are beveled.

18. A method of mounting a spacer between a pair of adjacent electrostatic precipitator plates in order to maintain the plates in a horizontally spaced relationship, wherein each of said plates is of the type having a generally planar vertically extending surface spaced horizontally from and extending parallel with the planar surface of the adjacent plate, and in which a vertically extending rib is formed on each of the plates and projects perpendicularly from the planar surface inwardly toward the rib on the adjacent plate, the spacer including a brace which is adapted to extend horizontally between said adjacent pair of precipitator plates at the vertically extending ribs thereof, said brace having an open groove at each end thereof, the groove having a width sufficient to compressively engage the vertically extending ribs therein, the brace having two plate engaging edges at opposite ends thereof, each of said plate engaging edges having a length of at least about 25% of the horizontal interplate spacing between adjacent precipitator plates comprising:

orienting the spacer between the adjacent plates so that at least one rib extends into a groove and a diagonal dimension of the spacer is presented between the plates, the diagonal dimension being no more than about 3% greater than the horizontal interplate spacing, rotating the spacer about an axis until the plate engaging edges abut against the adjacent plates with the ribs positioned in the open grooves at either end of the spacer.

19. The method claim 18, wherein the spacer is first mounted on an elongated tool having an axis which is substantially in line with the rotational axis of the spacer.

20. The method of claim 19, wherein the spacer is rotated by rotating said tool.

21. The method of claim 18, wherein the spacer is rotated by pulling opposite ends of the spacer with ropes engaged therein.

* * * * *